US005697014A

United States Patent [19]

Makino

[11] Patent Number: 5,697,014

[45] Date of Patent: Dec. 9, 1997

[54] TONER LEVEL DETECTING DEVICE HAVING A SUBSTANTIALLY NON-UNIFORM WIDTH AND TONER STORAGE BOX HAVING SAME

[75] Inventor: Kazumasa Makino, Nagoya, Japan

[73] Assignee: Brother Kogyo Kabushiki Kaisha, Nagoya, Japan

[21] Appl. No.: 638,578

[22] Filed: Apr. 29, 1996

[30] Foreign Application Priority Data

Dec. 28, 1995 [JP] Japan ..... 7-39458
Apr. 3, 1996 [JP] Japan ..... 8-9535

[51] Int. Cl.[6] ..... G03G 15/10

[52] U.S. Cl. ..... 399/65; 399/30; 399/64

[58] Field of Search ..... 399/27, 29, 30, 399/61, 62, 64, 65, 258, 260, 262

[56] References Cited

U.S. PATENT DOCUMENTS

| | | |
|---|---|---|
| 3,274,392 | 9/1966 | Harling . |
| 4,197,813 | 4/1980 | Yano et al. . |
| 4,292,530 | 9/1981 | Nepper et al. . |
| 4,389,972 | 6/1983 | Hirakura et al. . |
| 4,620,781 | 11/1986 | Miyamoto . |

(List continued on next page.)

FOREIGN PATENT DOCUMENTS

| | | |
|---|---|---|
| 950 258 | 9/1956 | Germany . |
| 55-163562 | 12/1980 | Japan . |
| 60-2660 | 1/1985 | Japan . |
| 61-248066 | 11/1986 | Japan . |
| 62-16964 | 1/1987 | Japan . |
| 62-044780 | 2/1987 | Japan . |
| 62-63880 | 3/1987 | Japan . |
| 63-2087 | 1/1988 | Japan . |
| 1-302282 | 12/1989 | Japan . |
| 1-316766 | 12/1989 | Japan . |
| 2-73262 | 3/1990 | Japan . |
| 2-198473 | 8/1990 | Japan . |
| 3-53232 | 11/1991 | Japan . |
| 6-222631 | 8/1994 | Japan . |
| 7-281519 | 10/1995 | Japan . |

OTHER PUBLICATIONS

English-language abstract of Japanese reference No. 55-163562.

English-language abstract of Japanese reference No. 60-2660.

English-language abstract of Japanese reference No. 61-248066.

English-language abstract of Japanese Utility Model Publication No. 62-16964.

(List continued on next page.)

*Primary Examiner*—Matthew S. Smith
*Attorney, Agent, or Firm*—Oliff & Berridge

[57] ABSTRACT

A toner level detecting device on a toner fillable box includes first and second toner detecting portions formed of a light transmissive material and a toner fillable aperture formed between the first and second toner detecting portions, wherein the toner fillable aperture has a non-uniform width. The toner fillable aperture is cleaned using a cleaning blade mounted to rotate within the toner fillable aperture to clean toner from the inside surfaces thereof, thereby providing more accurate toner level detection. The toner fillable aperture is a generally V-shaped or U-shaped member having smooth transitions such that toner does not collect or accumulate in corners where a cleaning blade cannot reach after possible being deformed during use. Furthermore, the material of at least a portion of the toner fillable aperture and/or the toner detecting portions is formed of a semi-transparent material that absorbs latent light that might otherwise cause inaccurate toner level measurement.

22 Claims, 20 Drawing Sheets

U.S. PATENT DOCUMENTS

| | | | |
|---|---|---|---|
| 4,646,679 | 3/1987 | Ohno et al. . | |
| 4,665,808 | 5/1987 | Pulvermüller . | |
| 4,937,628 | 6/1990 | Cipolla et al. . | |
| 4,963,929 | 10/1990 | Ueda et al. . | |
| 4,989,111 | 1/1991 | Sato . | |
| 4,993,661 | 2/1991 | Tollefson . | |
| 5,036,358 | 7/1991 | Yoshida . | |
| 5,078,303 | 1/1992 | Kikuchi et al. . | |
| 5,121,275 | 6/1992 | Komiyama . | |
| 5,160,963 | 11/1992 | Haneda et al. . | |
| 5,172,003 | 12/1992 | Nasu et al. . | |
| 5,216,462 | 6/1993 | Nakajima et al. . | |
| 5,235,389 | 8/1993 | Kikuchi et al. . | |
| 5,319,421 | 6/1994 | West | 399/59 |
| 5,383,007 | 1/1995 | Kinoshita et al. . | |
| 5,384,629 | 1/1995 | Watanabe et al. . | |
| 5,398,106 | 3/1995 | Eguchi . | |
| 5,424,816 | 6/1995 | Fox et al. . | |
| 5,428,427 | 6/1995 | Lee . | |
| 5,489,976 | 2/1996 | Ichikawa . | |
| 5,499,077 | 3/1996 | Endo et al. . | |
| 5,506,665 | 4/1996 | Ishida et al. . | |
| 5,530,528 | 6/1996 | Houki et al. | 399/61 |
| 5,557,368 | 9/1996 | Endo et al. | 399/27 |

OTHER PUBLICATIONS

English–language abstract of Japanese reference No. 62–63880.

English–language abstract of Japanese reference No. 63–2087.

English–language abstract of Japanese reference No. 1–302282.

English–language abstract of Japanese reference No. 1–316766.

English–language abstract of Japanese reference No. 2–73262.

English–language abstract of Japanese reference No. 2–198473.

English–language translation of Japanese Utility Model Publication No. 3–53232.

English–language abstract of Japanese reference No. 6–222631.

TONER LEVEL DETECTING DEVICE HAVING A SUBSTANTIALLY NON-UNIFORM WIDTH AND TONER STORAGE BOX HAVING SAME

BACKGROUND OF THE INVENTION

1. Field of the Invention

This invention relates to toner containing devices for use with toner development devices such as printers, facsimile machines, etc. In particular, this device relates to a toner containing device having a toner level detecting section capable of providing an accurate indication of the level of toner within a toner box.

2. Description of Related Art

Heretofore, the toner level within a toner box has been monitored using a sensor arrangement having a photointerrupter including a light emitting element and a light receiving element located on opposite sides of a toner fillable aperture formed between a pair of toner detecting portions projected inward from a wall of the toner box. Toner level is detected by determining whether toner occupies the toner fillable aperture, which is periodically cleaned using a cleaning blade that typically rotates with a shaft provided inside the toner box.

With this arrangement, light emitted from the light emitting element passes through the first toner detecting portion, through the toner fillable aperture between the toner detecting portions, and then through the second toner detecting portion to finally reach the light receiving element. When the toner level in the toner supply chamber is high, the light is blocked by toner between the toner detecting portions. When the toner level in the toner supply chamber is low, or zero, the light is received by the light receiving element.

However, the toner fillable aperture is typically constructed in a substantially rectangular cross-sectional shape which includes hard to reach corners that may not receive adequate cleaning action from the cleaning blade, which further may be subject to permanent deformation during use. As such, toner may adhere to the inside surfaces of the toner fillable aperture near the corners, and there is a possibility that the light from the light emitting element will not reach the light receiving element because of the adhered and uncleaned toner that is not accessible to the cleaning blade, thus causing a false detection signal indicating high toner level when the toner level is actually low or possibly near empty.

Conversely, there is a possibility that the light from the light emitting element may be repeatedly internally reflected in the toner detecting portions and a connecting portion formed therebetween such that the light is indirectly transmitted from the light emitting element to the light receiving element. In addition, there is a possibility that the light from the light emitting element may be simply reflected once on the inner bottom surface of the connecting portion to reach the light receiving element. Light transmitted along these optical paths can cause a false detection signal indicating "low toner level" or "zero toner level" when the toner level is actually still high.

SUMMARY OF THE INVENTION

It is therefore an object of the present invention to overcome the above described disadvantages of the prior art. It is another object of this invention to provide a tapered toner fillable aperture having a non-uniform cross-sectional width that is cleaned using a conforming cleaning blade mounted to rotate within the toner fillable aperture to clean toner from the inside surfaces thereof, thereby providing more accurate toner level detection.

It is another object of the present invention to provide a toner fillable aperture having generally smooth transitions such that toner does not collect or accumulate in corners where a cleaning blade cannot reach after possibly being deformed during use.

It is another object of the present invention to provide a cleaning blade for a blow-molded toner fillable aperture, which may not have a uniform cross-sectional width.

It is another object of the present invention to provide a toner body having an integrally formed toner fillable aperture made of a semi-transparent material capable of attenuating latent light that could otherwise cause inaccuracies in toner level detection.

In accordance with these objects and according to one aspect of the present invention, there is provided a toner level detecting device on a toner fillable box comprising first and second toner detecting portions formed of a light transmissive material, and a toner fillable aperture formed between the first and second toner detecting portions, the toner fillable aperture being detected to determine toner level within the toner fillable box, wherein the toner fillable aperture has a non-uniform width.

In accordance with another aspect of the present invention, there is provided a toner storage box comprising a toner fillable casing, a toner level detecting device on the casing comprising first and second toner detecting portions formed of a light transmissive material, and a blow-molded toner fillable aperture formed between the first and second toner detecting portions, a rotating shaft provided in the casing, the rotating shaft being rotatable by a mechanism outside the casing, and a cleaning member attached to the rotating shaft, wherein rotation of the rotating shaft causes the cleaning member to pass between opposed inner surfaces of the first and second toner detecting portions to clean toner from inner surfaces of the blow-molded toner fillable aperture.

According to other preferred embodiments, the blow-molded aperture may include a non-uniform width, and the cleaning member may include a pair of opposed flexible members that conform to the non-uniform width of the blow-molded aperture to clean the inner surfaces, and the blow-molded aperture may be substantially V-shaped or substantially U-shaped. The opposed flexible members may include a slit to allow a lower portion of each of the opposed flexible portions to deform an amount different than that of an upper portion of each of said opposed flexible portions closer to the shaft.

According to still another aspect of the present invention, there is provided, in combination, a toner developing unit coupleable to a removable toner storage box comprising a developing case having a support, a toner fillable casing mountable on the support, a toner level detecting device on the toner fillable casing comprising first and second toner detecting portions formed of a light transmissive material and a toner fillable aperture having a substantially non-uniform cross-sectional width formed between the first and second toner detecting portions, and a toner level detector mounted on the development case, the toner level detector cooperating with the first and second toner detecting portions and the toner fillable aperture to provide an indication of the amount of toner within the toner fillable aperture. According to preferred embodiments, the toner detector may be fixedly attached to a ramped toner detector support in an optimum toner detecting position.

According to yet another embodiment of the present invention, there is provided a toner level detecting device on a toner fillable box comprising a toner fillable body, first and second toner detecting portions formed on the toner fillable body and structured to receive a toner level detector, and a toner fillable aperture formed between the first and second toner detecting portions on the toner fillable body, said toner fillable aperture being detected using the toner level detector to provide an indication of toner level within the toner fillable body, wherein at least a portion of at least one of the first and second toner detecting portions and the toner fillable aperture is formed from a semi-transparent material that absorbs latent light that might otherwise cause a false indication of the toner level.

These and other aspects of the invention will be described and/or apparent from the following detailed description of the preferred embodiments.

BRIEF DESCRIPTION OF THE DRAWINGS

Preferred embodiments of the invention will be described in conjunction with the attached drawings, wherein.

DETAILED DESCRIPTION OF PREFERRED EMBODIMENTS

Figure 1A:
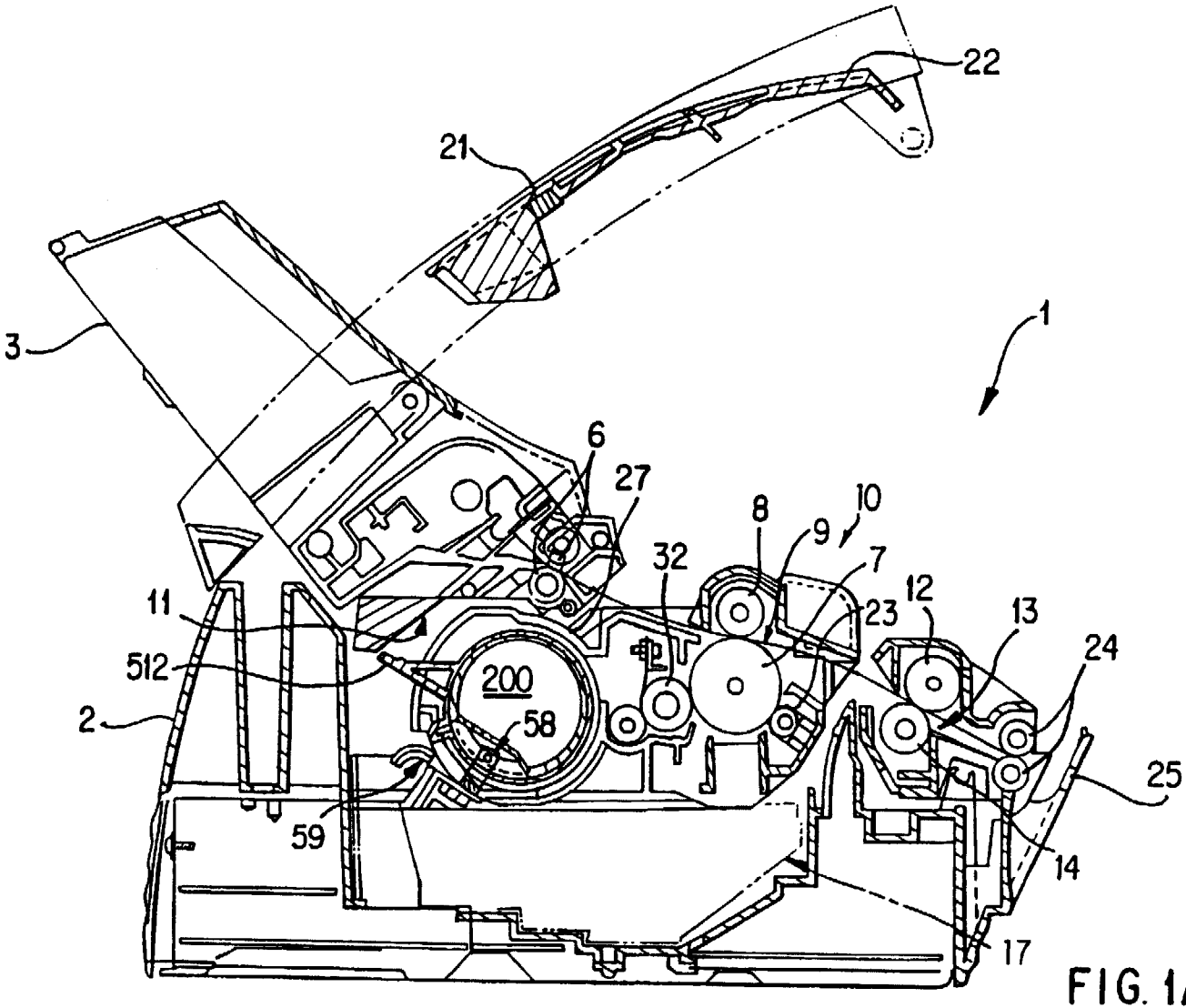
FIG. 1A illustrates the overall architecture of a printer according to the present invention in which a development device is shown in a proper fitted condition.
Figure 1B:
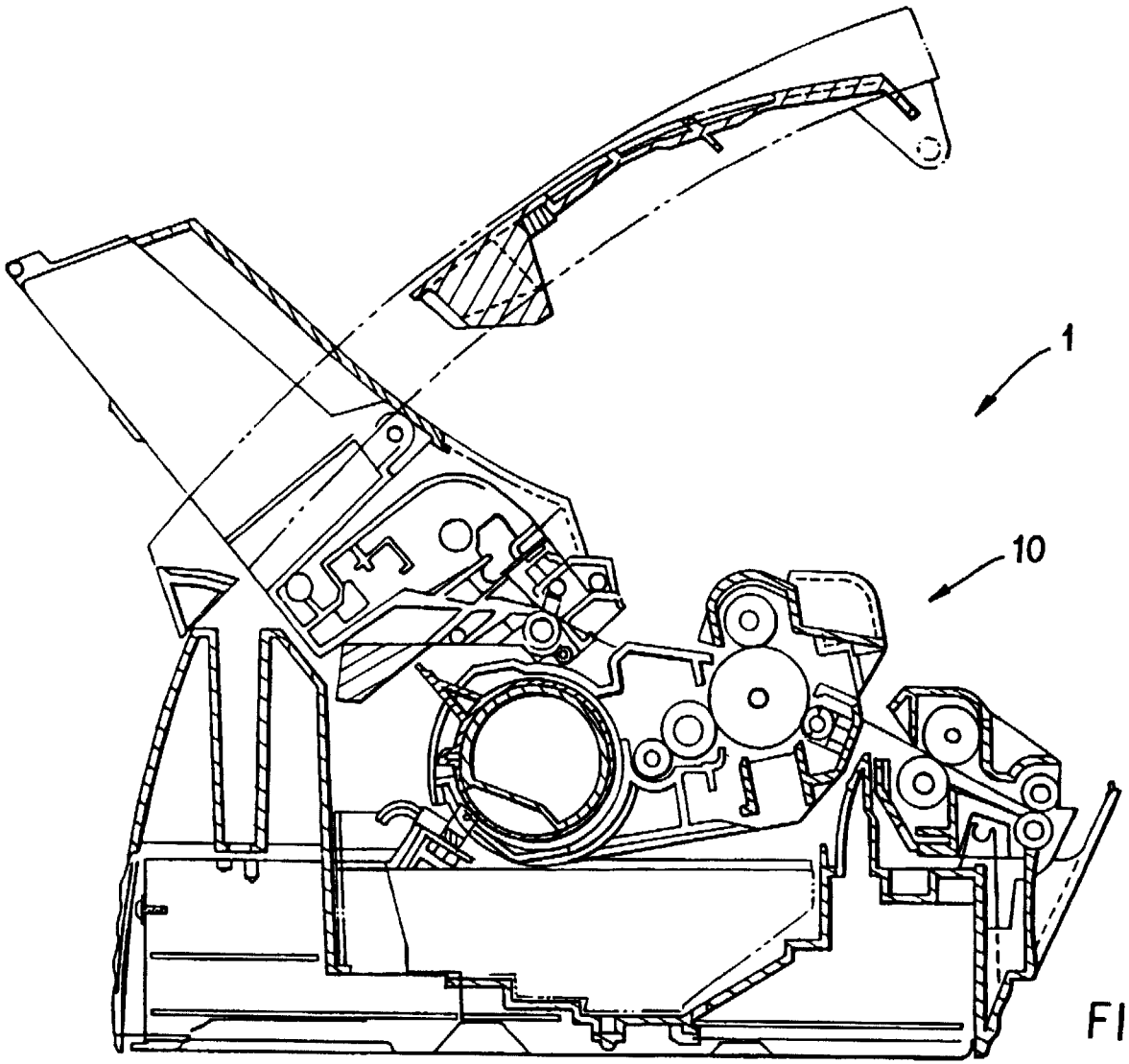
FIG. 1B illustrates the overall architecture of the printer according to the present invention in which the development device is shown in an incomplete fitted condition.
Figure 1C:
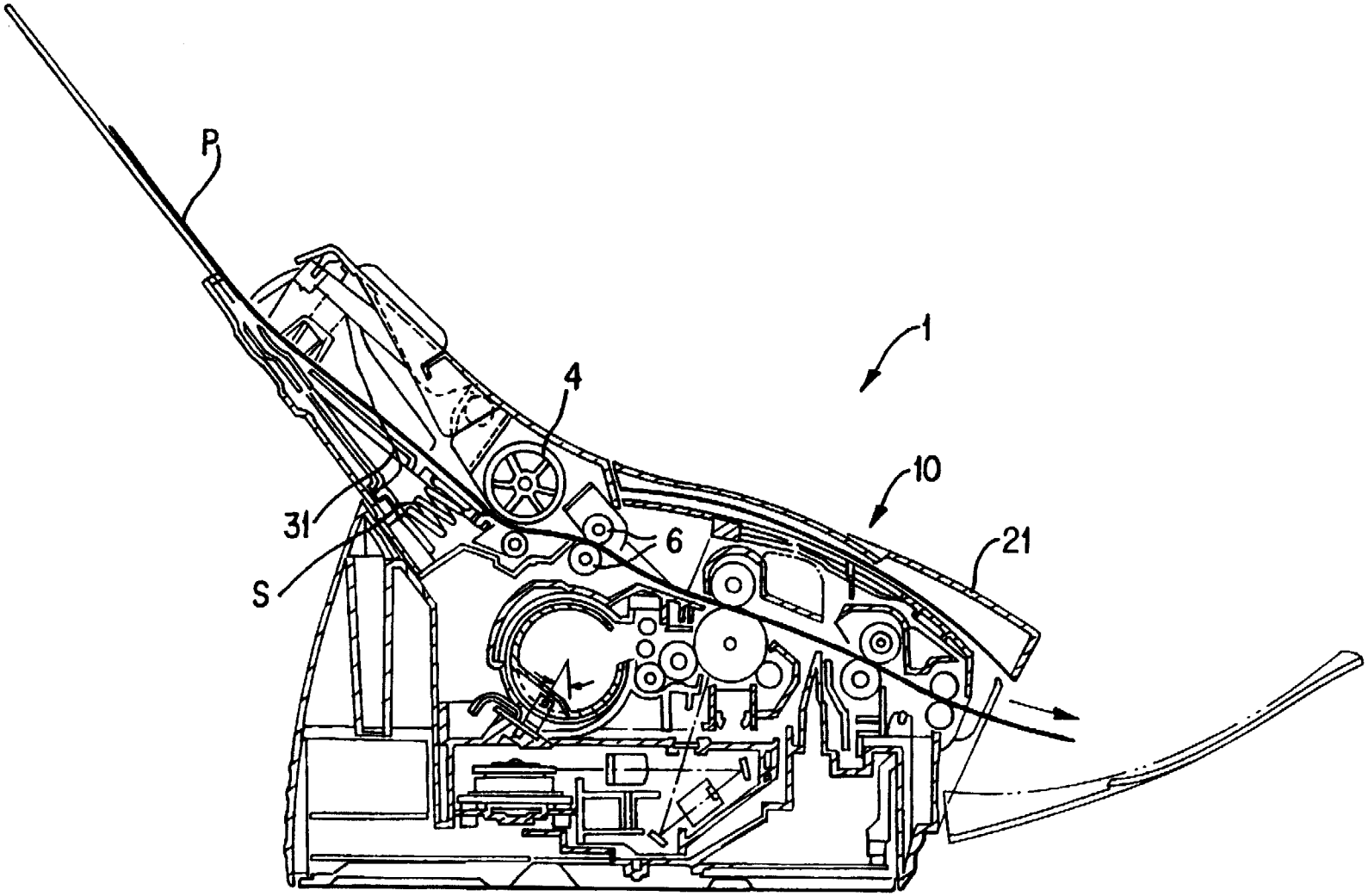
FIG. 1C illustrates the printer according to the present invention in the fully assembled and operative state.

A developing device according to one preferred embodiment of the present invention will be described. An image recording apparatus such as a printer 1 is shown in the open condition in FIGS. 1A and 1B, and FIG. 1C shows the printer 1 in an operative condition. FIGS. 1A–1C show a developing device 10 constructed according to the present invention.

The printer 1 has a main frame 2 and a sheet cassette 3 provided detachably from an upper one side of the main frame 2. The sheet cassette 3 is provided with a plate member 31 that is biased using a spring S toward a sheet supply roller 4 (FIG. 1C) provided for transporting individual sheets from the sheet stack held in the sheet cassette 3, which is then supplied along a paper path P in the printer 1. A pair of sheet feed rollers 6 are disposed downstream of the sheet supply roller 4 for feeding each sheet P to a photosensitive unit 9. The photosensitive unit 9 includes a photosensitive drum 7 and a transfer roller 8.

A developing device 10 is provided in the vicinity of the photosensitive unit 9 and at a position closer to the sheet cassette 3 than the photosensitive unit 9, whereas a fixing unit 13 is positioned opposite the developing device 10 with respect to the photosensitive unit 9. The developing device 10 includes a developing case 27 fixed in the main frame 2, a toner box 200 provided detachably with respect to the developing case 27, and a developing sleeve 32 positioned in contact with the photosensitive drum 7. The fixing unit 13 includes a heat roller 14 and a pressure roller 12.

At a position below the photosensitive unit 9 are disposed a scanner unit 17, a control board and a power unit etc. The scanner unit 17 includes a laser emitting portion, a lens, and a plurality of reflection mirrors, etc. A keyboard 22 having a plurality of operation buttons is provided on a cover member 21. A charger 23 is provided for electrically charging the photosensitive drum 7. A pair of discharge rollers 24 are provided downstream of the fixing unit 12, and a discharge tray 25 is provided downstream of the discharge rollers 24.

Further, a toner sensor 58 is provided along a ramp 59 to detect the toner amount in the toner box 200. The positioning of the toner sensor 58 on the ramp 59 is selected when the printer 1 is manufactured so as to optimize toner level detection as the toner level within the toner box 200 diminishes so that the amount of toner within the toner box can be continuously monitored to provide an accurate measurement of toner. In this way, an operator can monitor the toner level and order a replacement toner cartridge 200 when the toner is low. This is a decided advantage over current toner level detector structures in which the toner detectors are fixed in one position without repositioning capability, which may not fully take into account manufacturing tolerances and may result in improper toner level detection. The toner detector 58 makes an angle with respect to a vertical axis of about 33 degrees, as shown in FIG. 1C.

Figure 2:
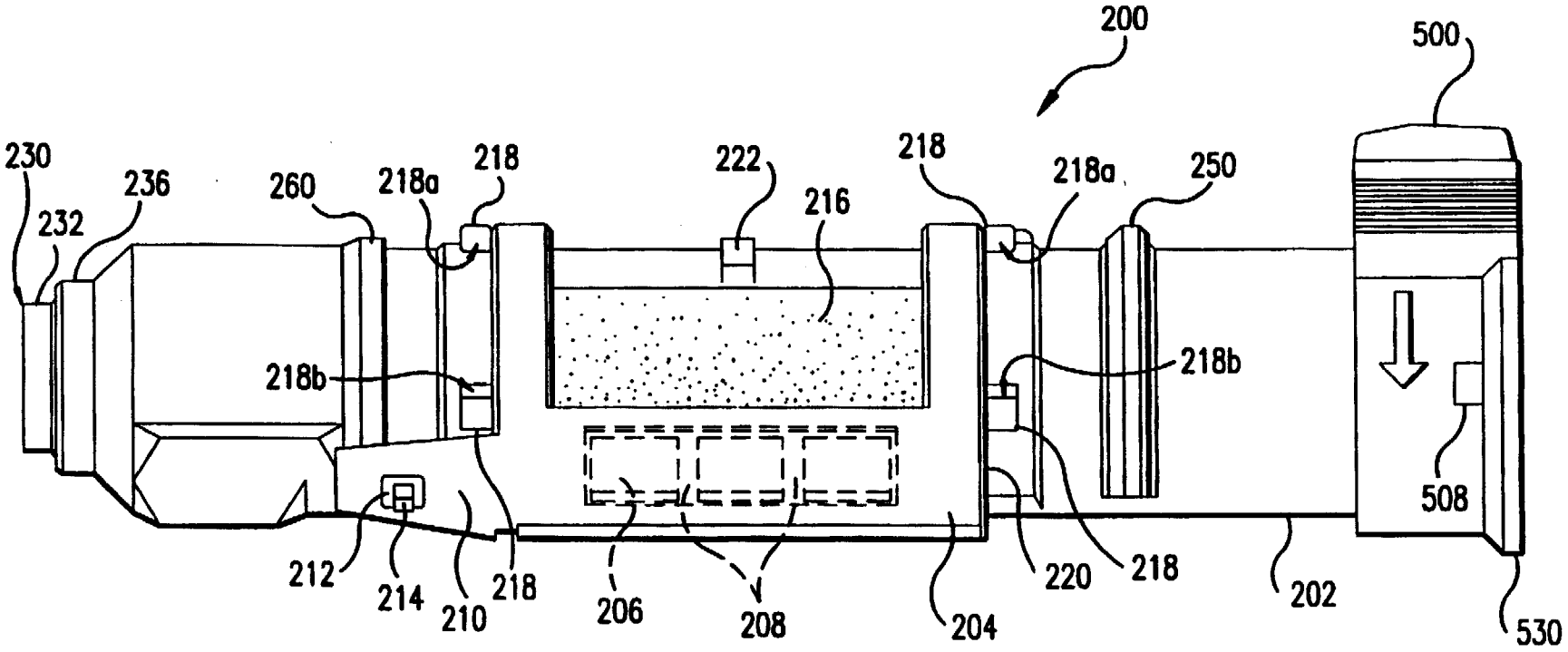
FIG. 2 illustrates a toner box according to the present invention.

FIG. 2 illustrates the toner box 200 shown in the position where it is removed from the developing device 10. The toner box 200 includes a blow-molded resin body 202 having a plurality of integrally molded projections described in more detail below. The blow-molded resin body 202 can by made by any suitable blow-molding technique using any suitable resin that has good properties relating to flexibility, and which does not react with the toner or promote adherence between the toner and the inside surface of the toner box 200. Although vinyl chloride and polyethylene terephthalate (PET) resins can be used to produce the blow-molded resin body 202, polypropylene is one preferred resin, which also has excellent recyclability, in addition to being inexpensive.

The blow-molded resin body 202 includes a cap 500 and a toner box shielding member 204 that is structured to rotate with respect to the blow-molded resin body 202 to selectively open and close a toner exhaust port 206 which may include a plurality of dividing posts 208. The toner box shielding member 204 includes an extension 210 having a recess 212 which cooperates with an integrally blow-molded locking projection 214 formed integrally with the blow-molded resin body 202. The toner box shielding member 204 remains in a position covering the toner exhaust port 206 when the toner box 200 is in transport such that toner is prevented from escaping from the blow-molded resin body 202. A toner absorbing member 216 is provided, i.e., adhered, adjacent and surrounding the toner exhaust port 206 to wipe toner from an inside surface of the toner box shielding member 204, and also to absorb any toner that escapes from the toner exhaust port 206. The toner exhaust port 206 can be cut into the toner body 202 by inserting a cutting implement inside the toner body 202, and cutting the toner exhaust port 206 from the inside to the outside of the toner body 202.

The blow-molded resin body 202 includes a plurality of projections 218 that guide lateral edges 220 of the toner box shielding member 204, e.g., when the locking projection 214 is released from the recess 212 and the toner box shielding member 204 rotates with respect to the toner body 202 to expose the toner exhaust port 206. As shown in FIG. 2, for example, a pair of projections 218 are formed on each lateral edge 220 of the toner box shielding member 204, and each of the pair of projections includes an inner surface 218*c* (FIG. 3) that faces the center of the blow-molded toner body 202.

To facilitate rotation of the toner box shielding member 204 with respect to the blow-molded resin body 202, a plurality of guiding ribs are formed on the blow-molded resin body 202. As shown in FIG. 2, a central rib 222 is provided to guide a central portion of the toner box shielding member 204 which is located on an opposite side of a blow-molded resin body 202 shown in FIG. 2. The opposite side of the toner box shielding member is shown in FIG. 20.

Figure 3:
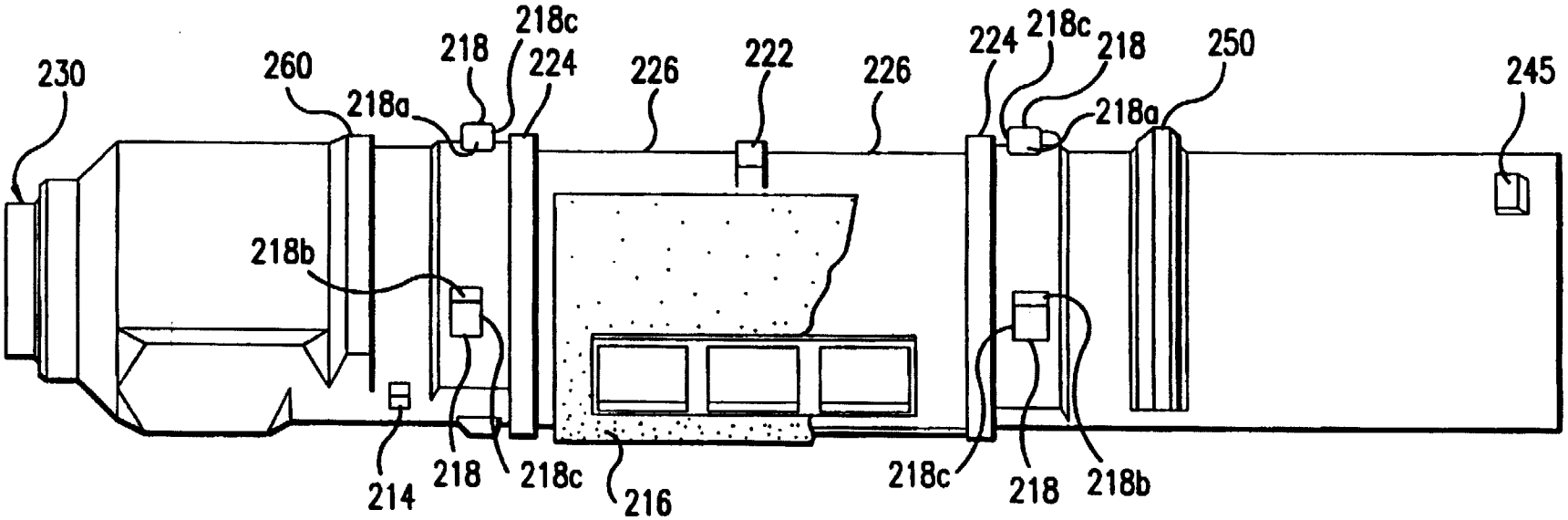
FIG. 3 illustrates a blow-molded resin toner body according to the present invention.

As shown in FIG. 3, a pair of lateral guiding ribs 224 are disposed just below the toner box shielding member 204 adjacent the projections 218. In FIG. 3, the toner box shielding member 204 and cap 500 have been removed to facilitate understanding. The center rib 222 and lateral ribs 224 ensure that a small space is maintained between the inner surface of the toner box shielding member 204 and a circumferential outer surface 226 of the blow-molded resin body 202 adjacent the center rib 222 and the lateral ribs 224. The center rib 222 and the lateral ribs 224 also increase the resistance of the perimeter of toner exhaust port 206 to deform or radially shrink, which is advantageous because the toner box shielding member 204 cannot provide good toner retaining qualities if the toner exhaust port is overly deformed.

The height of the center rib is dimensioned to extend a distance that is less than a height that the toner absorbing member 216 extends away from the outer circumferential surface 226 of the blow-molded resin body 202 so that firm contact is maintained between the toner absorbing member 216 and the inside surface of the toner box shielding member 204. However, the heights of the center rib 222 and the lateral ribs 224 are also dimensioned to prevent excessive deformation of the toner absorbing member 216. Also as shown in FIG. 3, the toner absorbing member 216 is shown to completely surround the toner exhaust port 206 to provide complete absorption of any toner that inadvertently escapes from the toner exhaust port 206.

Figure 20:
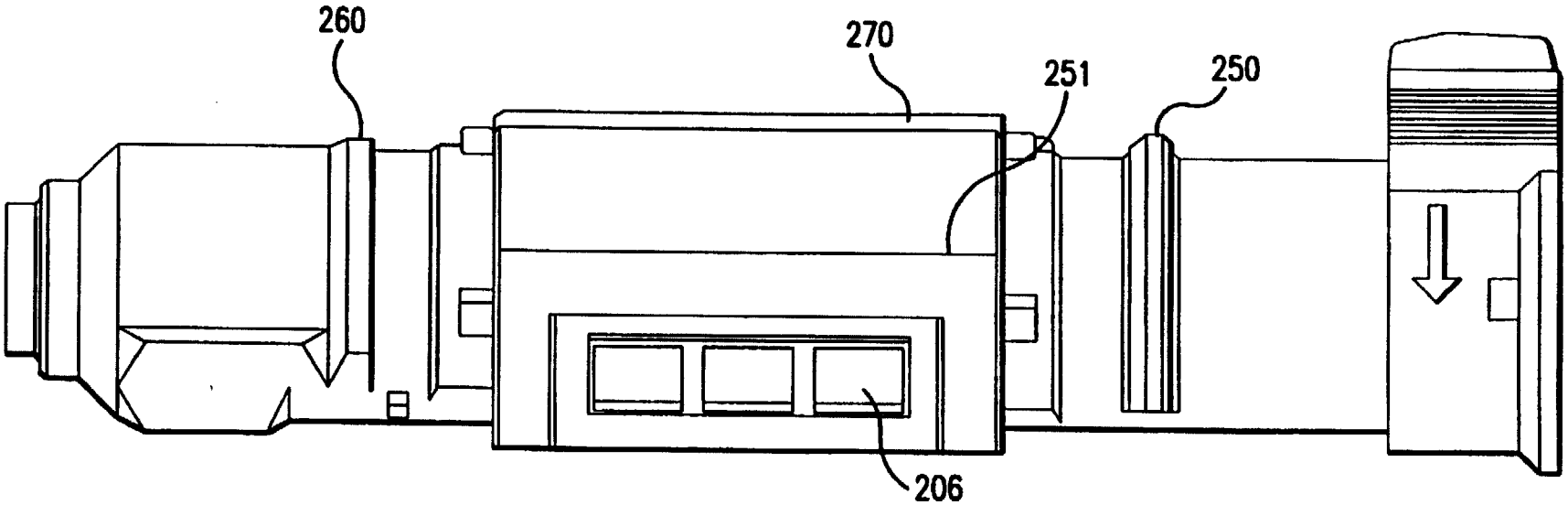
FIG. 20 illustrates a toner box according to the present invention in which the toner box shutter member has been rotated to open a toner exhaust port.

The toner box shielding member 204 is a two-part assembly having first and second shell portions connected using resiliently releasable snap fittings located along dividing line 251 in FIG. 20. In clam shell like fashion, the first and second shells are positioned over the central rib 222 and the lateral ribs 226, in addition to the toner exhaust port 206, between the projections 218.

Figure 4:
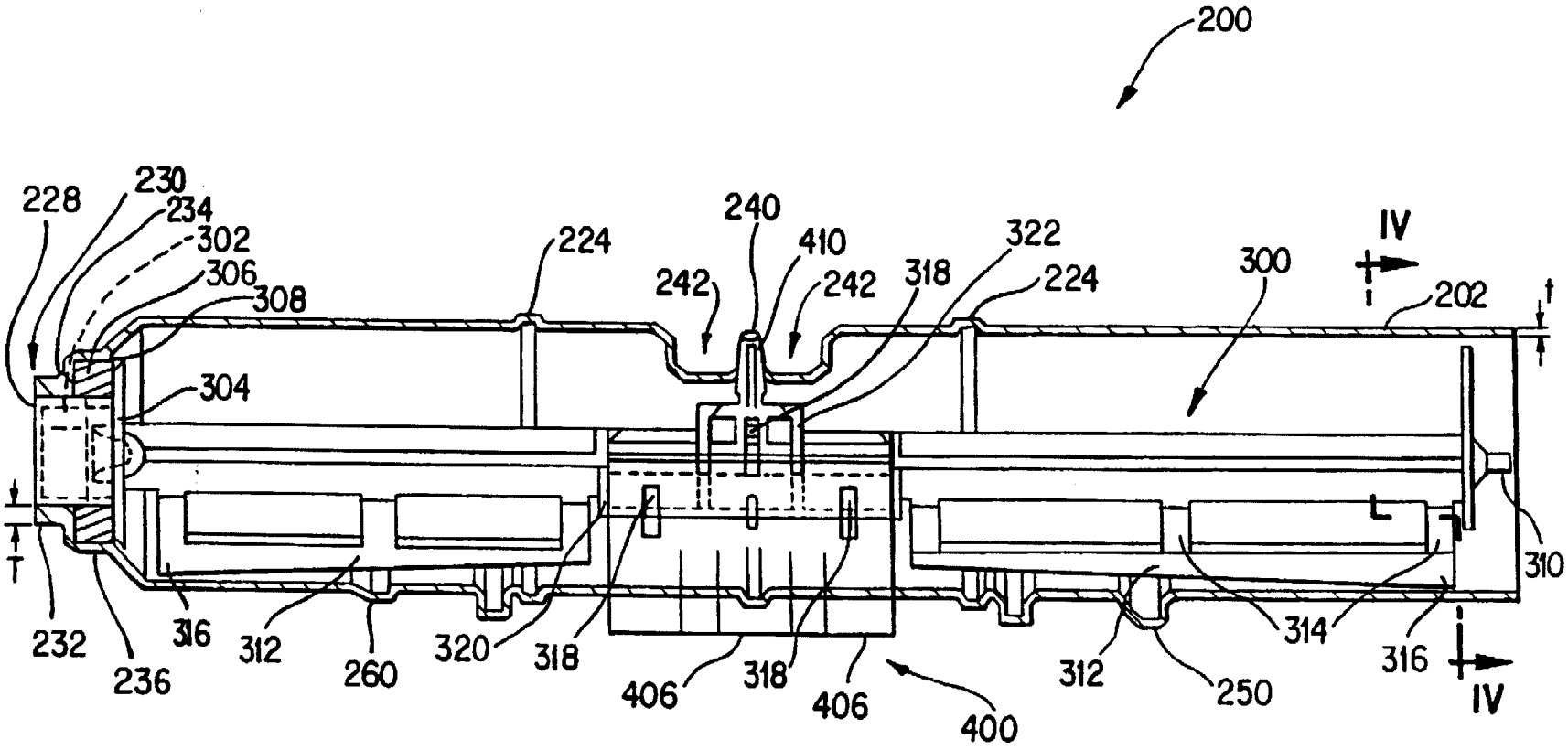
FIG. 4 illustrates a blade and shaft assembly inserted within the blow-molded toner body according to the present invention.

FIG. 4 illustrates a cross-sectional view of the toner box 200 showing the interior component of the blow-molded resin body 202 to include a shaft 300 and a central agitating blade 400 that are rotatably mounted within the blow-molded resin body 202. The shaft 300 includes a bearing member 302 that rotatably engages an inner surface 228 of a matching bearing member 230 of the blow-molded resin body 202. The shaft 300 includes an integrally molded flange 304 that is fixedly attached to the bearing member 302. The shaft 300 and the flange 304 rotate with respect to the blow-molded resin body 202 as the inner surface 228 frictionally engages and slides with respect to the circumferential surface of the bearing member 302.

The bearing member 230 has a thickness spanning the inner surface 228 and an outer surface 232 of the blow-molded toner body 202 which is thicker than remaining portion of the blow-molded resin body 202. The thickness T of the bearing member 230 and the thickness t of the remaining portions of the blow-molded resin body 202 are shown in FIG. 4. The bearing member 230 also includes a transition portion 234 that is reinforced to provide a good connection between the bearing member 230 and the blow-molded resin shaped body 202. The transition portion 234 forms an angle with the outer surface 232 of the bearing member 228 of approximately 135°.

Formed adjacent the bearing member 230 is a stepped portion 236 that defines an annular region surrounding a portion of the bearing member 302 for supporting a compressible toner sealing member 306 disposed between the flange 304 and the bearing member 228. When the shaft 300 is properly installed within the blow-molded resin body 202, the toner sealing member 306 does not rotate with respect to the flange 304 to enhance the sealing effect. In order to prevent premature wear from friction generated between the sealing member 306 and the flange 304, a thin anti-friction film 308 can be provided between the flange 304 and the sealing member 306. The thin anti-friction film 308 has a diameter greater than that of the flange 304. Disposed at the opposite end of the bearing member 302 is a bearing pin 310 that is rotatably supported within the cap 500, as described below.

Figure 5:
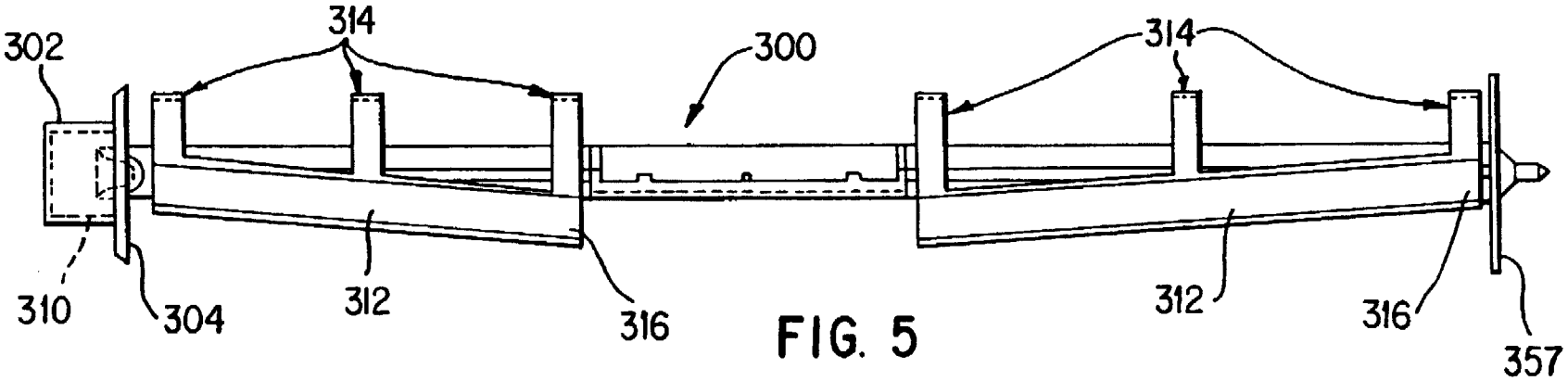
FIG. 5 illustrates a plan view of the integral blade and shaft assembly rotated 90° with respect to the integral blade and shaft assembly shown in FIG. 4.

As seen in FIG. 5, the shaft 300 also includes a pair of lateral agitating blades disposed on each end of the shaft 300. The shaft 300 in FIG. 5 is rotated 90° in relation to the shaft 300 shown in FIG. 4. Each lateral agitating blade 312 is integrally molded to the shaft 300 using at least one connecting portion 314. As shown in FIGS. 4 and 5, three connecting portions 314, for example, are used to connect each lateral agitating blade 312 to the shaft 300. The lateral agitating blades 312 are formed such that edges thereof, preferably along the entire length thereof, extend into close contact with the interior surface of the blow-molded resin body 202 to scrape toner therefrom. Each lateral agitating blade 312 is flexibly deformed against the interior surface of the blow-molded resin body 202, and the slightly helical shape of each of the blades 312 is formed such that the flared ends 316 are shifted in phase as compared to the center portion of the lateral blades 312, where the toner exhaust port 206 is located, as shown in FIG. 4. Thus, the arrangement of the blades 312 is generally V-shaped, and the flared ends 316 are phase shifted slightly ahead of the portions of the blades 312 closest to the toner discharge port 206 as the shaft 300 is rotated. See U.S. Pat. No. 5,506,665, assigned in common herewith and incorporated herein by reference. With this arrangement, toner flow is promoted from the ends of the toner box 200 towards the center portion of the toner box 200 where the toner exhaust port 206 is positioned. Once toner is urged by the lateral agitating blades 312 toward the toner exhaust port 206, it reaches the central agitating blade 400, described more fully below.

Figure 5A:
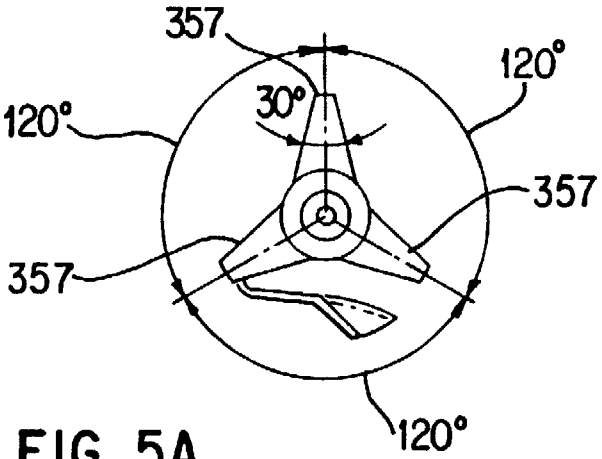
FIG. 5A illustrates a right side elevation view of the shaft and blade assembly of FIG. 5.

FIG. 5 illustrates that the connecting portions 314 increase in size toward the center of the toner box 200, thus providing more flexibility to allow the center portions of the lateral blades to move out a phase with respect to the flared ends 316. FIG. 5A shows the right end view of the shaft 300 shown in FIG. 5. At the opposite end of the bearing pin 310 are provided a plurality of blade members 357 separated by 120° intervals.

Figure 6:
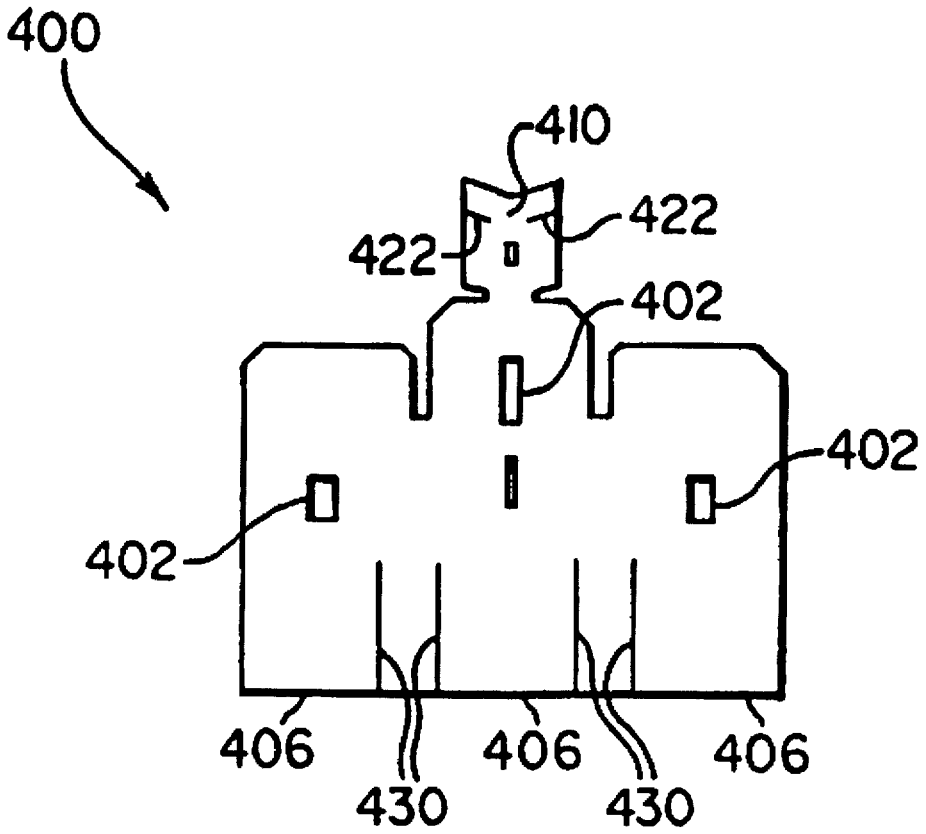
FIG. 6 illustrates a central blade according to the present invention.

Referring to FIGS. 4 and 6, the central agitating blade 400 includes a thin film material that is secured to the shaft using a plurality of clips 318 integrally molded onto the shaft 300 which are engageable with a series of recess 402 cut into the central agitating blade 400. Two clips 318, for example, are integrally formed on a planar support 320 which is integrally molded onto the shaft 300.

As shown in FIG. 4, the central agitating blade 400 is fixed to the shaft 300 such that individual blade members 406 extend outside the blow-molded toner body 202. The central agitating blade 400 is made from a thin material having a high flexibility such that the blade members 406 scrap along the inside circumferential surface of the blow-molded toner body 202 such that they are deformed against the inner circumferential surface thereby storing potential energy in the central agitating blade 400. The shaft 300 is rotated until the blade members 406 of the central agitating blade 400 are released from the inner circumferential surface of the toner box 200 to extend through the toner exhaust port 204 and outside the toner box 200, thereby releasing the stored potential energy and flicking toner from inside the toner box 200 into a developing case 27 of the developing device 10. The flicking of the toner is advantageous to spread toner more evenly, thereby avoiding pooling or accumulation of toner inside the developing case 27. The dividing posts 208 shown in FIG. 2 also contribute to the even spreading of toner, in addition to providing a measure against deformation, e.g., radial contraction of the toner exhaust port 206 during blow-molding of the blow-molded toner body 202.

Figure 4A:
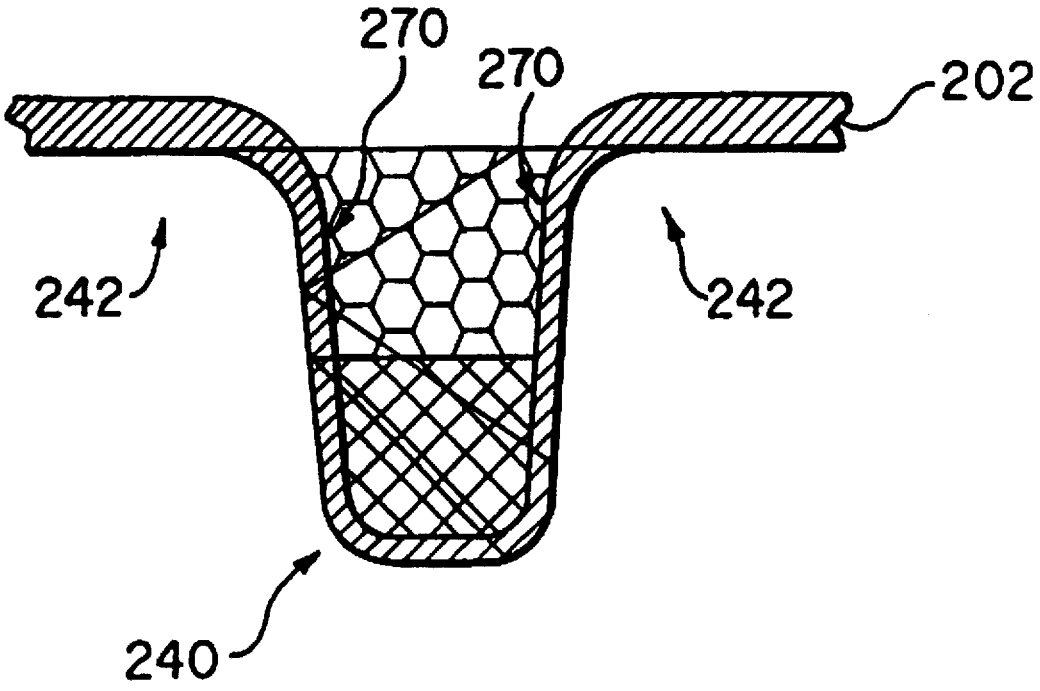
FIG. 4A illustrates a blown up view of a toner fillable aperture shown in FIG. 4.

The shaft member 300 also includes a radial extension 322 opposite the planar support 320 where yet another clip 318 is provided. The radial extension 322 provides a support surface for a cleaning blade 410 that is integrally formed with the blade members 406 on the thin material. Both the cleaning blade and the blade members 406 have a thickness in the range of about 0.075 to 0.15 millimeters and preferably have a thickness of about 0.125 millimeters. The cleaning blade 410 is disposed to rotate within a toner fillable aperture 240 (FIG. 4A) that is integrally blow-molded with the blow-molded resin body 202. Adjacent each side of the toner fillable aperture 240 is a toner detecting portion 242, each of which are adapted to receive a portion of the detector 58 shown in FIG. 1. The purpose of the cleaning blade 410 is to wipe residual toner from the interior side surfaces 270 of the toner fillable aperture so that the detector 58 can make an accurate reading of the amount of toner filling the toner fillable aperture 410. See U.S. Pat. No. 5,499,077, assigned in common herewith and incorporated herein by reference.

Because the toner box 200 is formed using a blow-molding technique, e.g., a preform is blow-molded with biaxial orientation deformation to create the blow-molded resin body including its plurality of projections, it is difficult to produce a toner fillable aperture that has a uniform cross section, such as disclosed in U.S. Pat. No. 5,499,077. Accordingly, the toner fillable aperture 240 includes a U-shaped or a V-shaped member in which the cross-sectional width thereof is non-uniform. Therefore, the cleaning blade 410 is provided with at least one slit, e.g., two slits 422, such that the cleaning blade 410 can conform to the shape of the toner fillable aperture 410, which may sometimes take on a bulb-like shape. The slits 422 are about 0.5 mm to about 5 mm in length, and allow variable deformation of the cleaning blade 410, e.g., an outer radial portion of the cleaning blade 410 can expand the same or a greater, less or different amount than the inner radial portion of the cleaning blade 410. The cleaning blade 410 is shown in the uncompressed state in FIG. 6, whereas FIG. 4 shows a compressed state of the cleaning blade 410.

The tapered shape of the toner fillable aperture 240, however, has a distinct advantage of its own. For example, typical toner fillable apertures have a rectangular cross-sectional width including sharp transitions that produce corners that are hard to reach using a cleaning blade, which is subject to deformation during use. Thus, the distal and lateral end portions of cleaning blades cannot adequately clean toner from the corners, to which toner adheres, and a false signal can be produced indicating that the toner level is high, when in fact it is low. The smooth shape of the toner fillable aperture 240 eliminates sharp corners, which can help avoid erroneous toner level indications because the tapered cleaning blade 410 can adequately clean the inside surfaces 270 of the toner fillable aperture 240.

Furthermore, as mentioned, the blow-molded resin body 202 is made, for example, of a resin material such as, for example, polypropylene, which can be blow-molded to be semi-transparent, thus allowing toner level detection of the toner fillable aperture to be carried out accurately. However, the semi-transparent nature or property of this resin material is also advantageous from the standpoint of attenuating, eliminating and/or absorbing unwanted latent light, which may be produced as a result of light reflected from the light emitter of the toner sensor 58 to the connecting wall between the toner detecting portions 242, which connecting wall also forms the bottom wall of the toner fillable aperture. See, for example, U.S. Pat. No. 5,499,077. Thus, the blow-molded resin body 202, especially the toner fillable aperture 240, is formed of a semi-transparent material, e.g., polypropylene, that allows an adequate amount of light to pass therethrough for toner level detection thereof, while at the same time absorbing any latent light beams that may be inadvertently reflected from ambient structure.

As shown in FIGS. 4 and 6, the central agitating blade 400 also include a plurality of slits 430 which define sections that align with the dividing posts 208 shown in FIG. 2. Thus, the sections between the paired slits 430 remain inside the toner box 200 as the central agitating blade 400 rotates past the toner exhaust port 206, which also helps promote agitation and toner spreading. The central agitating blade 400 has a length that extends through the toner exhaust port 204 in the range of 0.1 to 10 millimeters.

Figure 4B:
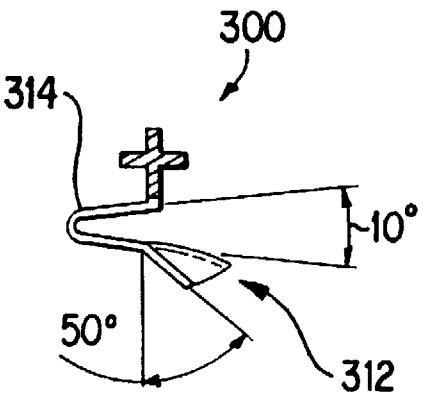
FIG. 4B illustrates a cross-sectional view of the shaft along section IV—IV in FIG. 4.

Furthermore, the connecting members 314 are flexible U-shaped support elements (FIG. 4B) that are increasingly deflectable towards the center of the toner box 200 such that a central portion of each lateral or side blade adjacent the toner exhaust port 204 can deflect more than an end portion 316 of each side blade 312 further from the toner discharge port 206. Each lateral or side blade 312 includes a slightly helical shape which, in part, defines the flared ends 316, and assists in urging toner toward the center of the toner box 200 as the shaft 300 rotates within the blow-molded toner body 202. The shaft 300 without the central agitating blade/cleaning blade 400/410 is shown in FIG. 5.

Referring back to FIG. 2, the cap 500 is provided on an end of the toner box 200 to sealably close the blow-molded resin body 202. Details of the cap are shown in FIGS. 7–11, and FIG. 12 shows the connection between the cap 500 and the shaft 300.

Figure 7:
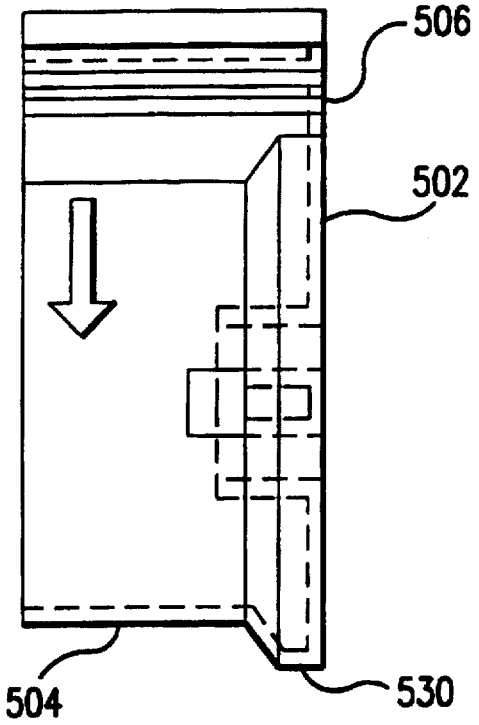
FIGS. 7 and 8 illustrate a first embodiment of a cap according to the present invention.
Figure 8:
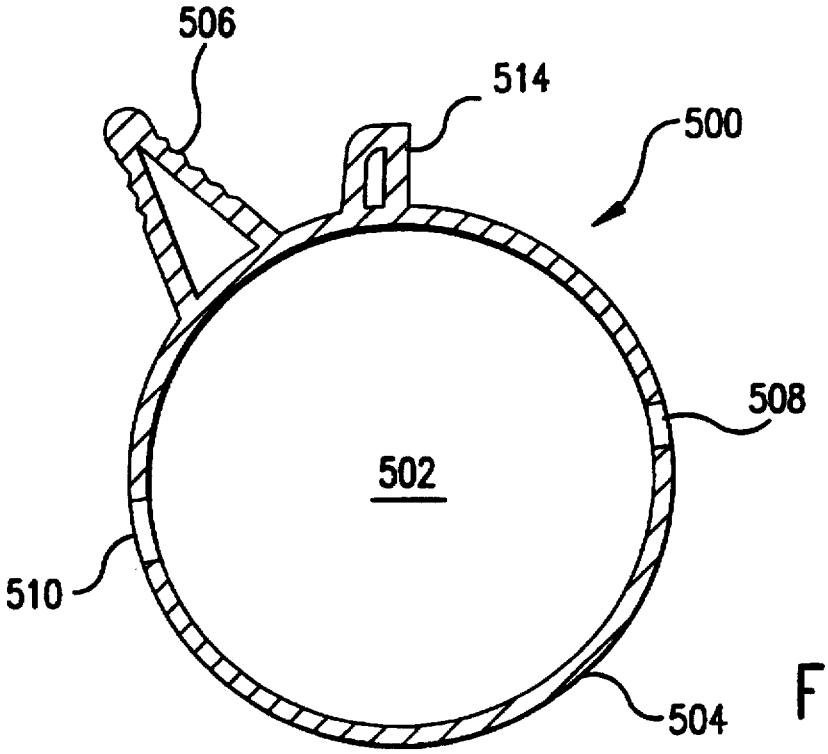
Figure 9:
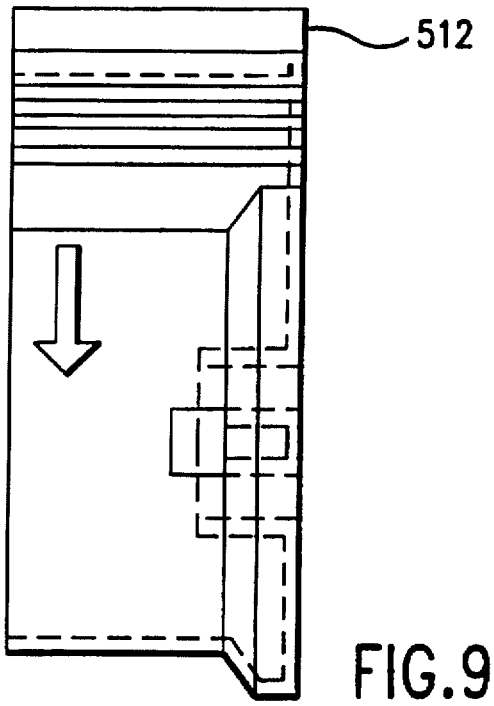
FIGS. 9–11 illustrate a cap according to a second embodiment according to the present invention.

Referring to FIGS. 7 and 8, the cap 500 includes an end wall 502 that is dimensioned to sealably mate with an end of the blow-molded toner body 202. In other words, the diameter of the blow-molded resin body 202 is dimensioned such that it fits within the interior of the cap 500. The cap 500 further includes a peripheral wall 504 defining a peripheral surface that is structured to slide over the blow-molded toner body 202. The knob 506 is connected to and extends radially away from the peripheral wall 504. The peripheral wall 504 includes circumferentially spaced recesses 508, 510 that are dimensioned slightly differently from one another so that they can be matched only in one predetermined orientation with respect to the blow-molded resin body 202. For this purpose, the blow-molded resin body 202 includes a pair of integrally blow-molded protrusions 245, only one of which is shown in FIG. 3, which meet with respective ones of the recesses 508 and 510. Once the integrally blow-molded projection 245 engage with the recesses 508 and 510, the cap 500 is positively locked against rotation with respect to the blow-molded resin body 202 such that manipulation of the knob 506 in concert with the blow-molded resin body 202 provides communication between the development device 10 (FIG. 1) and the toner box 200, as described in more detail below.

Figure 10:
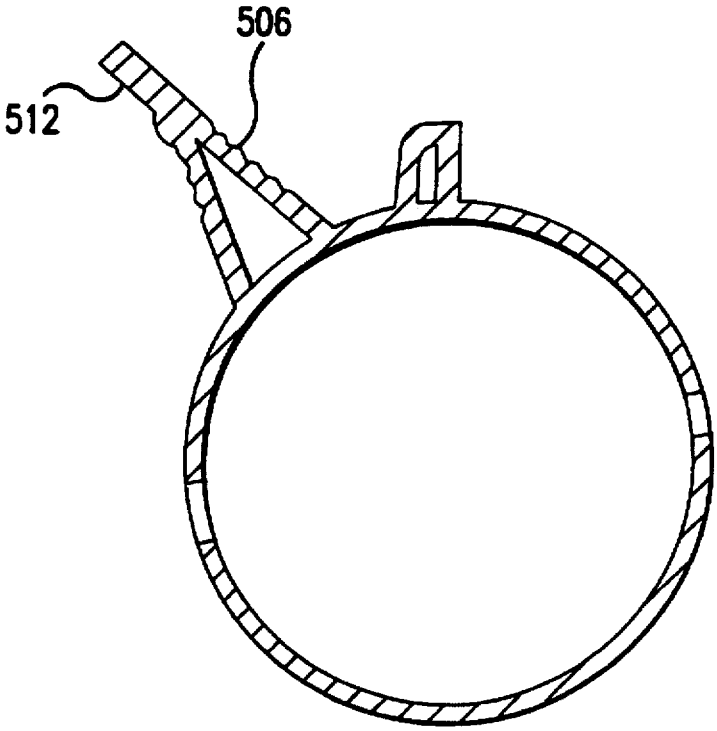

As one example, however, the knob 506 can be provided with an extension or engagement surface 512 as shown in FIGS. 1 and 10. The engagement surface 512 is dimensioned to engage with a projection 11 of the developing device 10, as schematically shown in FIG. 1. This engagement causes communication between the developing device 10 and the toner box 200 upon installation of toner box 200 within the developing device 10. For example, the engagement surface 512 has an end that contacts the projection 11 to cause counterclockwise rotation as shown in FIG. 1 of the toner box 200 over an angular extent of about 90° . Absent the extension 512 and the projection 11, the knob 506 can be manipulated to rotate the toner box 200 within the developing device 10.

Figure 17:
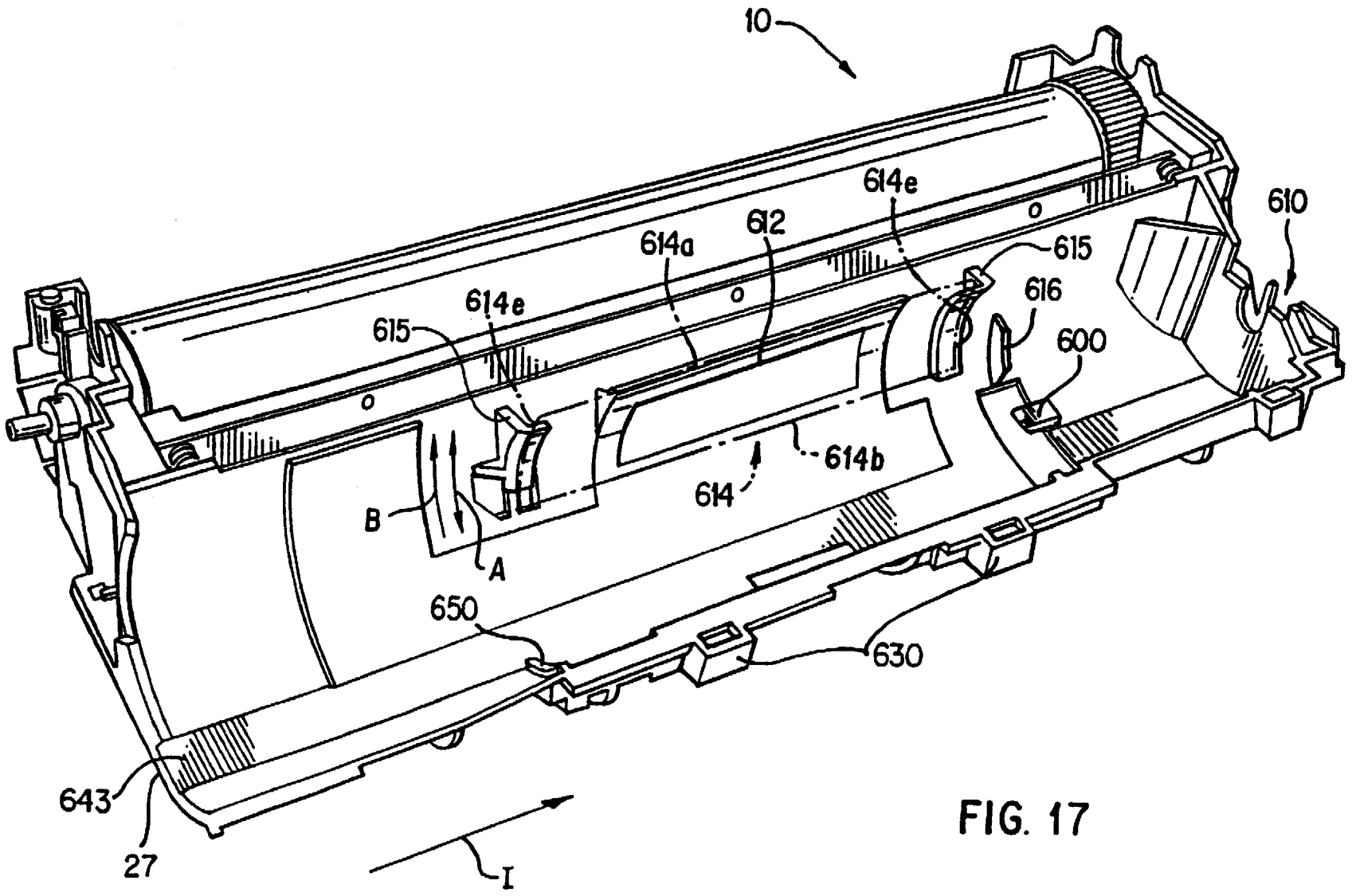
FIG. 17 illustrates a perspective view of the developing device according to the present invention.

However, it should be understood that rotation of the toner box 200 into the position shown in FIG. 1 causes communication between the toner exhaust port 206 and a toner introduction port 612 (FIG. 17). One way to achieve such rotation is by hand, in which case the rotation should be accomplished before installation of the development device 10 within the printer 1. However, if rotation is not performed before installation, i.e., the operator does not remember to rotate the toner box 200, proper transfer of toner cannot occur. Thus, the extension 612 automatically ensures rotation of the toner box 200 when the development device is installed into the printer 1. The progression of automatically closing the toner box 200 can be seen from the sequence from FIG. 1A, which shows a fully connected condition, to FIG. 1B, which shows an incomplete connected condition in which the toner box 200 is not yet properly rotated. FIG. 1C shows the printer 1 with the lid member 21 in the closed position along with the paper transport path P.

Regardless of how rotation is achieved, rotation is regulated using an engagement stop 514 of the cap 500 disposed on the peripheral wall 504 adjacent the knob 506. The engagement stop 514 contacts an abutment of a lower portion **27*a* of the developing case 27 when the toner box 200 has been rotated to the proper toner dispensing position. In this position, the toner sensor 58 becomes properly aligned with the toner detecting portions 242** shown in FIG. 4.

Figure 11:
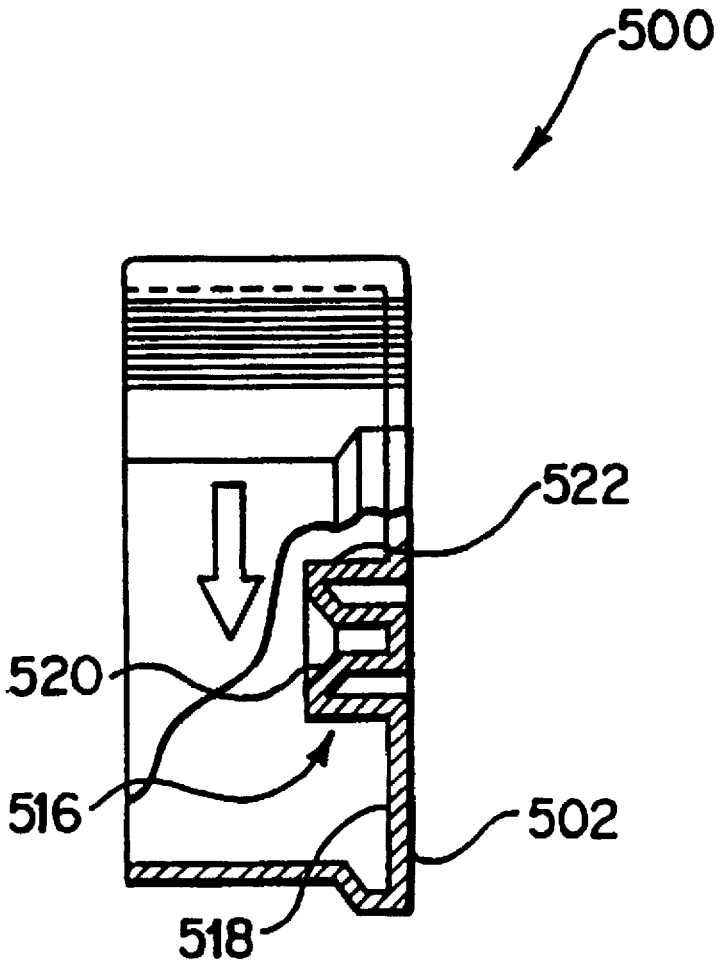
Figure 12:
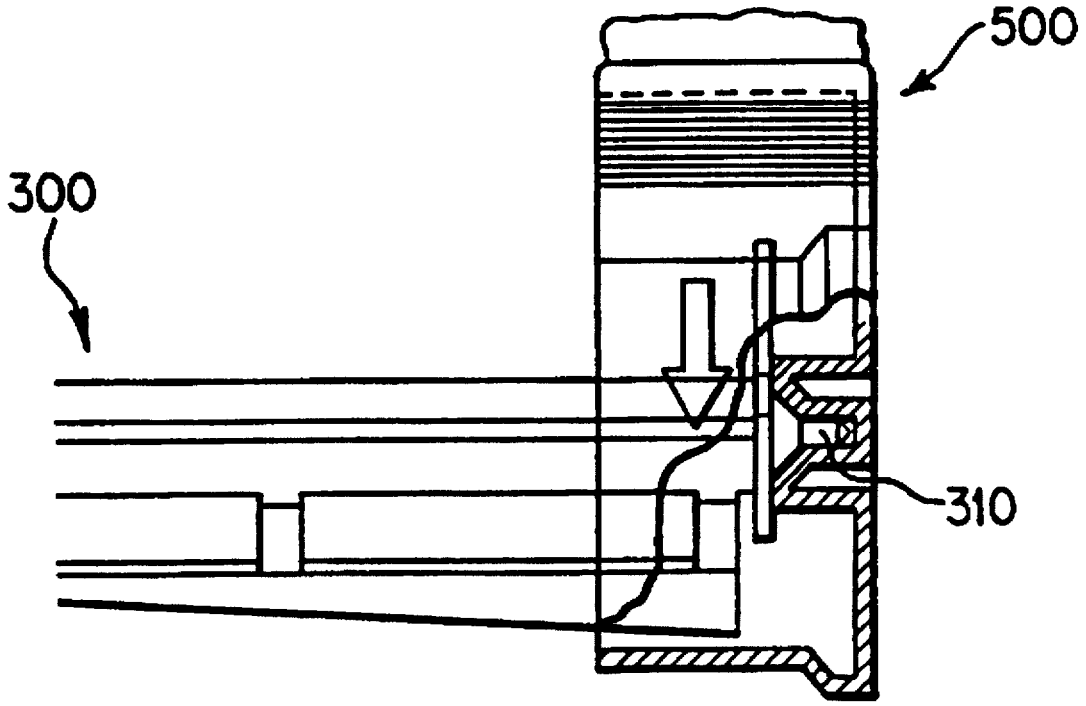
FIG. 12 illustrates the assembled connection between the shaft and cap according to the present invention.

According to another aspect of the cap 500, as shown in FIG. 11, there is provided a bearing support 516 mounted on an inner surface 518 of the inner wall 502 facing the blow-molded resin body 202. The bearing support 516 has an inner wall 520 defining a V-shaped groove that guides the bearing pin 310 of the shaft 300 as shown in FIGS. 4, 5 and 12. The bearing support 516 also includes an outer cylindrical wall 522 adapted to mount a foam seal (not shown) positioned along the end wall 502 for sealingly engaging the end of the blow-molded resin body 202.

Figure 13:
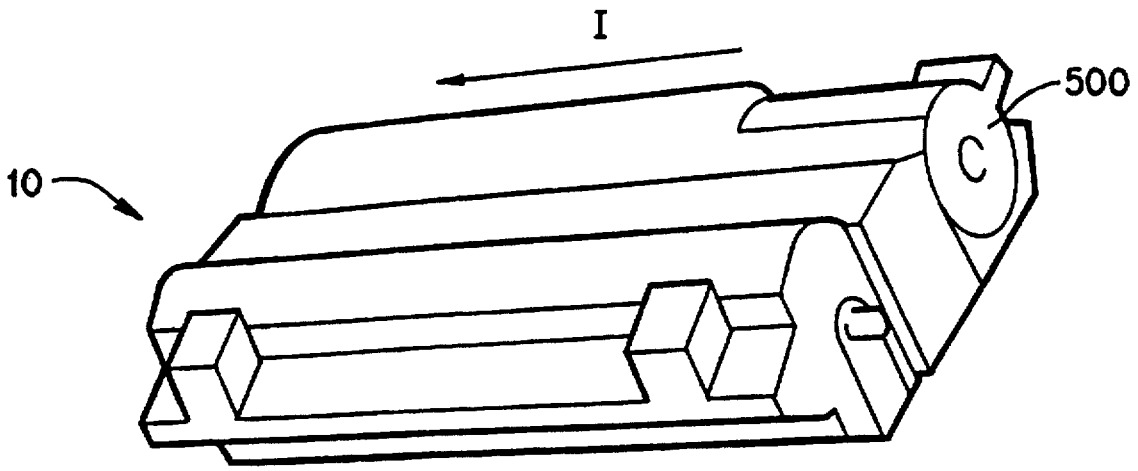
FIG. 13 illustrates a development device fitted with the cap according to the present invention.
Figure 14:
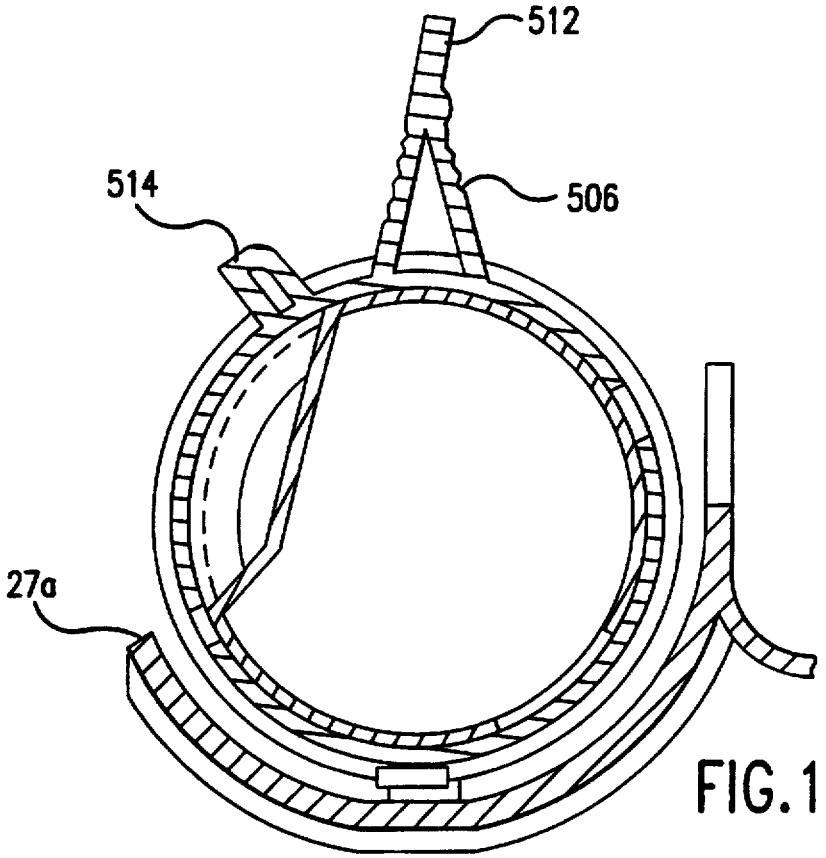
FIGS. 14 and 15 illustrate sequential rotation of the toner box within the development device according to the present invention.
Figure 15:
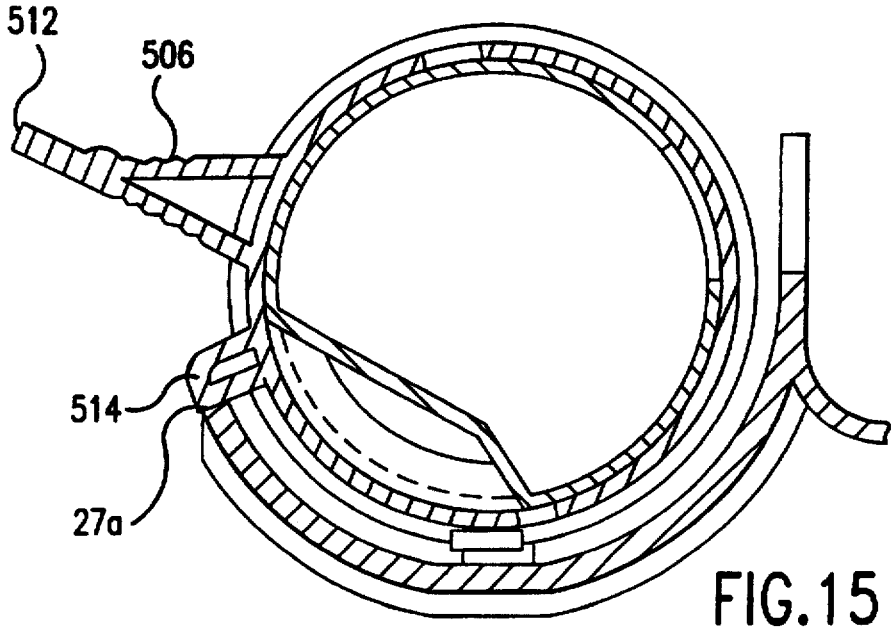

The installation of the toner box 200 with respect to the developing device 10 will be described with reference to FIGS. 13–15. In FIG. 13, the developing device 10 is shown in a position in which the developing device is connected to the toner box 200. The cap 500 is visible in FIG. 13. The end of the toner box 200 having the bearing member 230, as shown in FIG. 2, is first inserted in a direction I within the developing device 10 until the outside surface of the end cap 500 is substantially flush with the outside of the developing device 10. Once the toner box 200 is in this position, as shown in FIGS. 13 and 14, the knob 506 is rotated in a direction causing the engagement stop 514 to rotate towards the end wall **27*a* of the developing case 27. FIG. 15 shows a position of the toner box 200 in which the engagement stop 514 has engaged with the end wall 27*a* of the developing case 27. In the position of FIG. 15, the toner exhaust port 206 aligns with the toner introduction port 612 formed in a wall of the developing case 27**.

The interaction between the developing case 27 and the toner box 200 will now be described. Referring to FIG. 2, the blow-molded resin body 202 is provided with a main rib 250 and a supplemental rib 260. The main rib 250 is positioned on one side of the toner box shielding member 204 and toner exhaust port 206, and the supplemental rib 260 is provided on the opposite side of the toner exhaust port 206 furthest away from the cap 500. Both the main rib 250 and the supplemental rib 260 are C-shaped members, with the main rib 250 protruding a distance away from the outside circumferential surface 226 of the blow-molded resin body 202 that is greater than the distance the supplemental rib 260 extends away from the outside circumferential surface of the blow-molded resin body 202. Furthermore the cap member 500 includes a flange 530 that is disposed to be substantially aligned with the open end portion of the C-shaped main rib 250 and the supplemental rib 260. The open end or space of the C-shaped members 250 and 260 allow the toner box 200 to be slid into place without interference when inserted into the development device 10 in insertion direction I as shown in FIG. 13.

Figure 16:
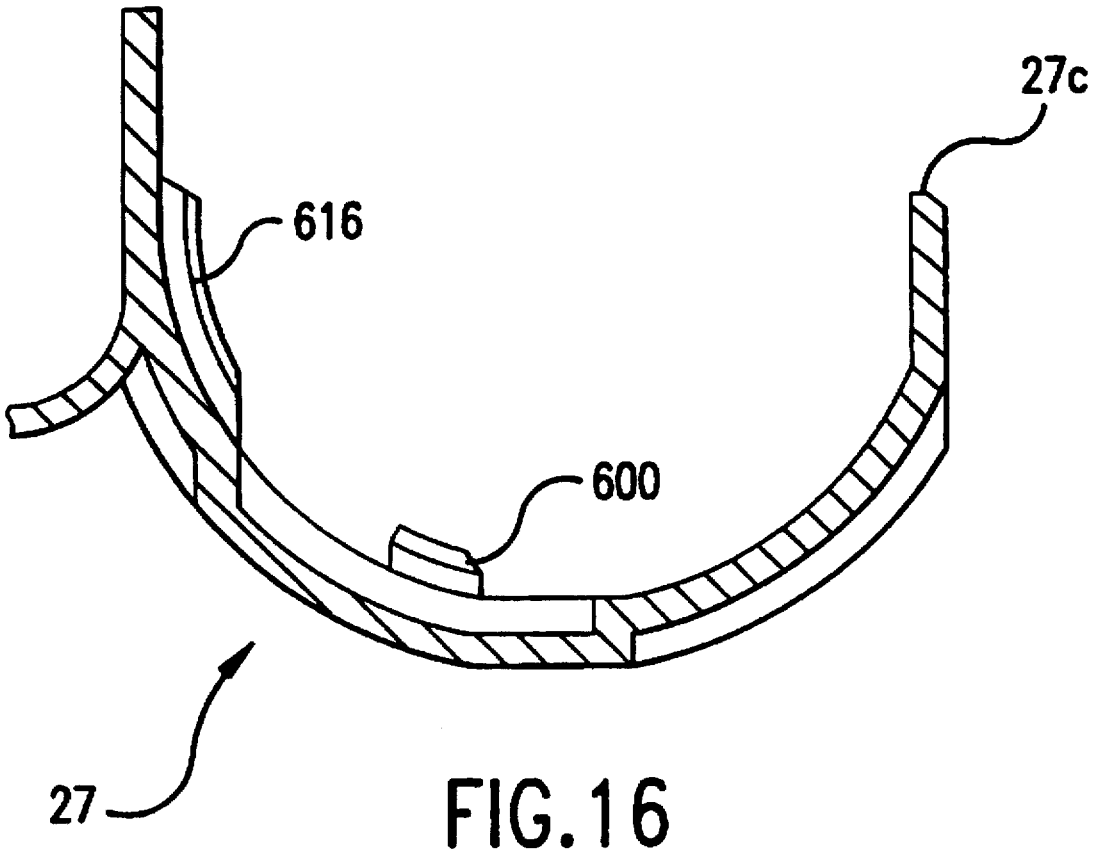
FIG. 16 illustrates a lock release projection formed on a wall of development device.

In addition, as shown in FIG. 16, insertion along direction I in FIG. 13 causes the extension 210 of the toner box shielding member 204 to engage a lock releasing projection 600 to bend the extension 210 away from the outside surface of the blow-molded resin body 202, thus releasing engagement between the locking projection 214 and the recess 212. In this state, the toner box 200 can be rotated with respect to the toner box shielding member 204 upon manipulation of the knob 506 of the cap 500.

As shown in FIG. 17, the developing case 27 includes a toner introduction port 612. Although the development device 10 includes upper and lower housing members, only the bottom housing is shown in FIG. 17 for clarity. The bottom housing includes insertion ports 630 for receiving mating protrusions of the upper housing. The toner introduction port 612 is also sealable using a case shielding member 614 that is movable as indicated by the arrow A to open and close the toner introduction port 612. The case shielding member 614 is displaceable along an arcuate path defined by a pair of grooved flanges 615 that support each end **614*e* of the shielding member 614. Formed at an opposite end of the development device 10 is a support 610 for housing a gear assembly (not shown) that is insertable into the bearing surface 310 (FIG. 5) of the shaft 300 to provide rotational power to the shaft 300. As mentioned with respect to FIG. 13, the toner box 200 is inserted along direction I until the end wall 502 of the cap 500 is substantially flush with the end of the development device 10. In this position, as shown in FIG. 14, i.e., before rotation of the knob 506, the supplemental rib 260 engages with an arcuate supplemental projection 616 which is mounted on the wall of the developing case 610. The engagement between the supplemental rib 260 and the supplemental arcuate projection 616 maintains the toner box 200 in the proper orientation such that it does not interfere with the developing case 610 upon insertion into the developing unit 10. The C-shape of both the main rib 250 and the supplemental rib 260 provides a space in the open end of the C-shape that also enhances ease of insertion of the toner box 200 into the developing device 10**.

Figure 18:
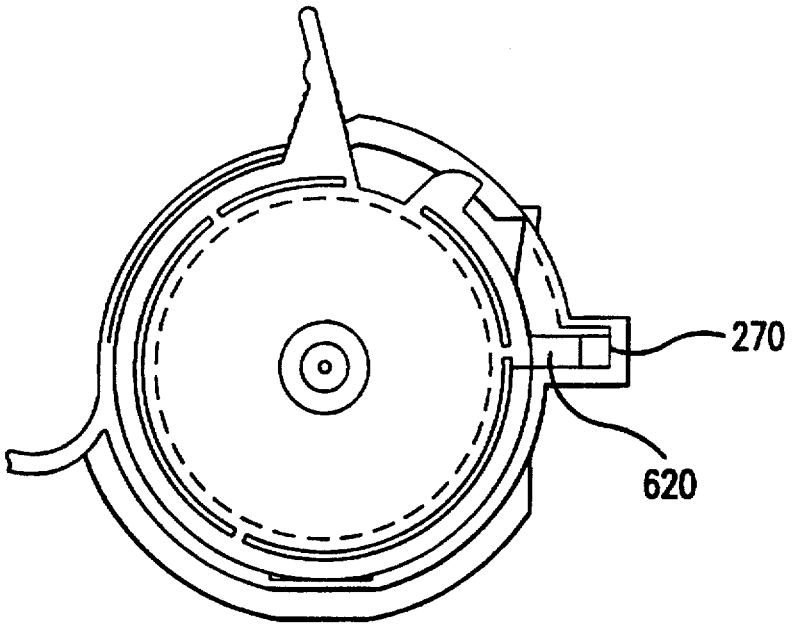
FIGS. 18 and 19 illustrate a sequential operation according to the present invention of rotation of the toner body including a longitudinal rib of a toner box shutter member formed within a slot of the development device.
Figure 19:
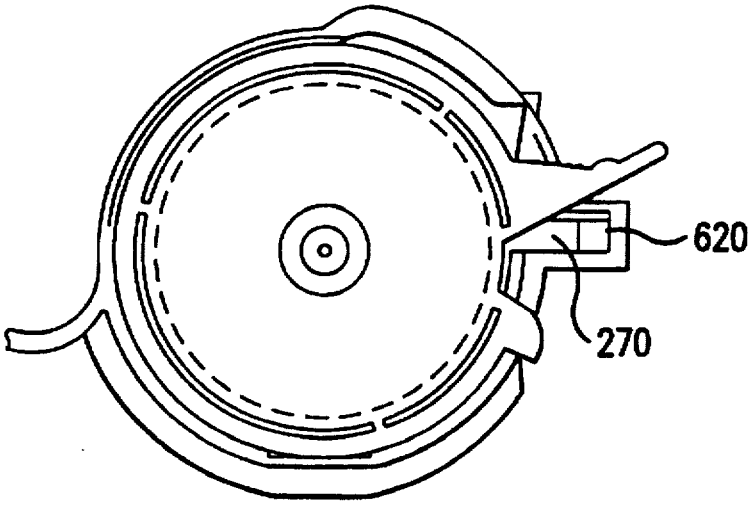

Upon rotation of the knob 506 in concert with the blow-molded resin body 202 from the position in FIG. 14 to the position shown in FIG. 15, the main rib 250 engages with an arcuate rib 650 mounted on an inside surface of the developing device 10. Simultaneously, the open end of the C-shape of the supplemental rib 260 departs from engagement with the supplemental arcuate projection 616. However, the supplemental arcuate projection 616 includes a plurality of circumferentially spaced members, one of which is formed on the top part of the developing device 10, which is shown in FIGS. 18 and 19, but not in FIG. 17. Thus, the supplemental rib 260, upon departure from the supplemental arcuate projection 616, engages yet another circumferentially spaced portion such that piece-wise continuous contact is made between circumferentially spaced portions of the supplemental arcuate projection 616 and the supplemental rib 260. The spaces between the spaced portions of the supplemental rib also provide room to insert the toner box 200 into the developing device 10 to prevent interference between the protuberances of the toner box 200 and the inside wall of the developing case 27.

With this structure, the supplemental rib 616 and its circumferentially spaced portions ensure that the toner box 200 is maintained in proper orientation and positioned with respect to the development case 610 upon rotation of the toner box 200 with respect to the development case. Engagement between the main rib 250 and the arcuate projection 650 causes a biasing or camming action that causes the toner exhaust port 206 to move closer to toner introduction port 612 as the toner box 200 is rotated. Therefore, less space is provided between the toner box 200 and the development chamber, thus decreasing the likelihood of toner escaping along undesirable portions of the developing device 10.

In addition, the above-described camming action causes the projections 218 of the blow-molded resin body 202 to move closer to the surface of the developing device 10 where the case shield 614 is slidably mounted. Therefore, opposed portions **218*a* and 218*b* of each pair of projections 218 firmly engages a lateral edge 614*a* and 614*b*, respectively, of the case shutter 614**.

Upon insertion of the toner box 200 into the developing device 10, the projections 218 slide along the lateral edges **614*a* and 614*b* of the case shutter 614. Similarly, the extension 210 of the toner box 200 slides along a planar surface 643 along the bottom of the developing case 27 (FIG. 17) until the extension 210 reaches the lock release projection 600. In this position and upon rotation of the toner box 200, the projections 218 are caused to move closer to the case shutter 614 while simultaneously engaging and displacing the case shutter 614 in the direction B. To remove the toner box 200 from the developing device 10, the above operation is reversed, i.e., the toner box is rotated from the position shown in FIG. 15 to the position shown in FIG. 14, thus displacing the case shutter 614 back to the position where it closes the toner introduction port 612, and the toner box 200 is then longitudinally slid along a direction opposite of that from the direction I shown in FIGS. 13 and 17**.

Simultaneously with the displacement of the case shutter 614 to a position where the toner introduction port 612 is open, the toner exhaust port 206 is rotated along with the blow-molded resin body 202 from a position below the toner introduction port 612 to a position substantially aligned with the toner introduction port 612. Therefore, when the toner box is rotated to the position shown in FIG. 15, the toner exhaust port is aligned with toner introduction port 612. Furthermore, the toner box shielding member 204 is stationary with respect to the developing device 10, so that rotation of the toner box 200 causes the blow-molded resin body 202 to rotate with respect to the toner box shielding member 206, thereby uncovering the toner exhaust port 204. When the toner box is rotated to the position shown in FIG. 15, therefore, the toner exhaust port 206 and the toner introduction port 612 are aligned and in open communication such that rotation of the shaft 300 causes the blade 400 to forcibly insert toner into the development case 27.

To prevent relative rotation between the developing device 10 and the toner box shielding member 204, the toner box shielding member 204 is provided with a longitudinal rib 270 (FIGS. 18 and 19) disposed within a slot 620 formed between the top and bottom portions of the development case 27 such that the toner box shielding member 204 is prevented from rotating with respect to the developing device 10. The rib 270 is also shown in FIG. 19 in which the toner box shielding member 204 is shown to be in a position uncovering the toner exhaust port 206.

Figure 21:
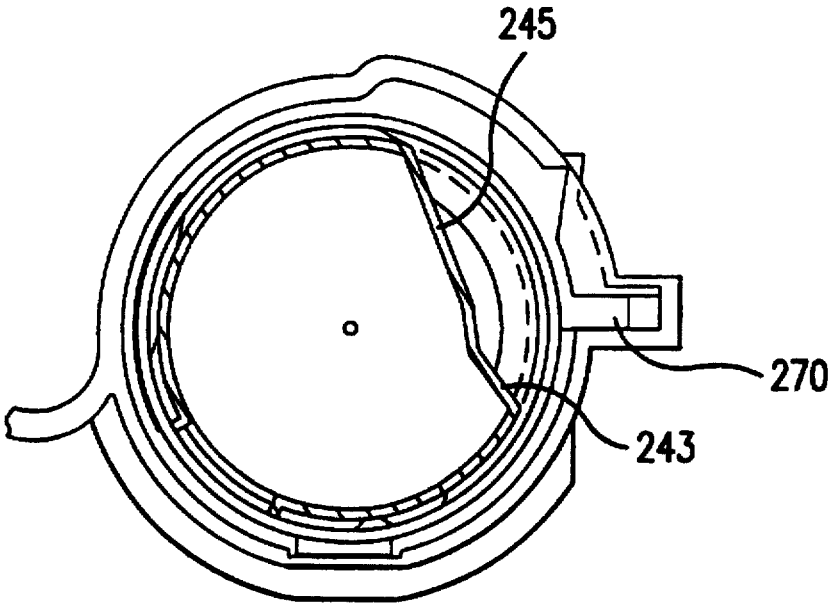
FIGS. 21 and 22 are cross-sectional views along a central portion of the toner box according to the present invention as it rotates to align toner detecting portions with a toner detector.
Figure 22:
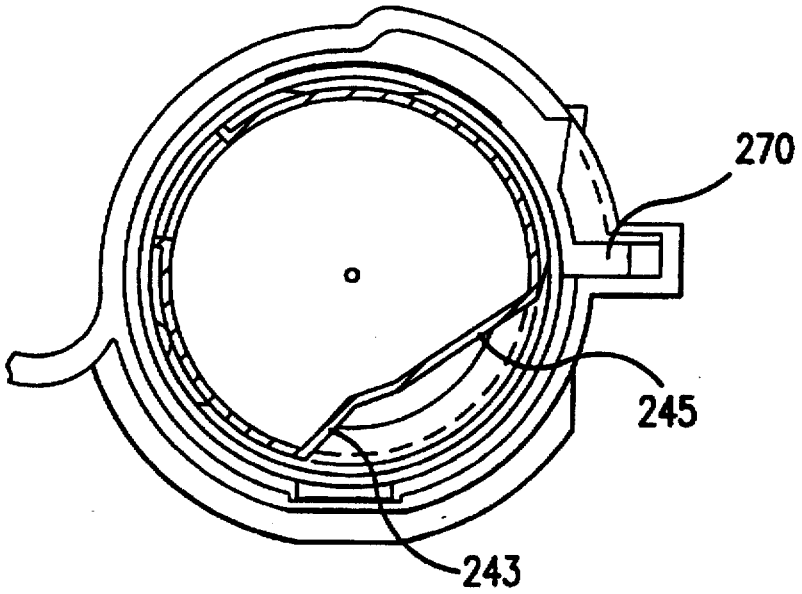

FIGS. 21 and 22 disclose a cross section through a middle portion of the toner box 200 where the toner level detecting portions 242 are located. FIGS. 21 and 22 correspond to the positions of the rotatable toner box 200 shown in FIGS. 14 and 15, respectively. As can be seen from the sequential positioning from FIG. 21 to FIG. 22, the toner detecting portions 242 are rotated to a position substantially along the bottom half of the toner box such that each half of the toner detector 58 (FIG. 1) can be inserted on either side of the toner fillable aperture 240. Each toner detecting portion 242 includes a groove-like portion 243 that allows the toner box to rotate while preventing improper engagement between the toner detector 58 and the toner detecting portions 242. Each toner detecting portion 242 also includes a second surface 245 below which the toner detector 58 is positioned when the toner box 200 reaches the position shown in FIGS. 1A and 22.

The invention has been described with reference to preferred embodiments thereof, which are intended to be illustrative, not limiting. Various modifications will be apparent to those of ordinary skill in the art without departing from the spirit and scope of the appended claims.

What is claimed is:

1. A toner level detecting device on a toner fillable box, comprising:

first and second toner detecting portions formed of a light transmissive material; and a toner fillable aperture formed between the first and second toner detecting portions, said toner fillable aperture being detected to determine toner level within the toner fillable box, wherein the toner fillable aperture has a non-uniform width from the top of the aperture to the bottom of the aperture.

2. The toner level detecting device according to claim 1, wherein the blow-molded aperture is substantially V-shaped.

3. A toner storage box, comprising:

a blow-molded toner fillable casing formed using a blow-molding technique;

a toner level detecting device on the casing, comprising:

blow-molded first and second toner detecting portions formed of a light transmissive material, said first and second toner detecting portions being formed integrally with the blow-molded toner fillable casing using said blow-molding technique, and a blow-molded toner fillable aperture formed integrally between the blow-molded first and second toner detecting portions during said blow-molding technique;

a rotating shaft provided in said blow-molded toner fillable casing, said rotating shaft being rotatable by a mechanism outside the blow-molded toner fillable casing; and a cleaning member attached to said rotating shaft, wherein rotation of the rotating shaft causes the cleaning member to pass between opposed inner surfaces of said blow-molded first and second toner detecting portions to clean toner from inner surfaces of the blow-molded toner fillable aperture.

4. The toner box according to claim 3, wherein the blow-molded toner fillable aperture includes a non-uniform width, and wherein said cleaning member includes a pair of opposed flexible members that conform to the non-uniform width of the blow-molded toner fillable aperture to clean said inner surfaces.

5. The toner box according to claim 4, wherein the blow-molded toner fillable aperture is substantially V-shaped.

6. The toner box according to claim 4, wherein the blow-molded toner fillable aperture is substantially U-shaped.

7. The toner box according to claim 4, wherein each of said opposed flexible members includes a slit to allow a lower portion of each of said opposed flexible members to deform an amount different than that of an upper portion of each of said opposed flexible members closer to the shaft.

8. The toner box according to claim 3, wherein the cleaning member comprises a thin film having a thickness ranging between 0.075 to 0.15 mm.

9. The toner box according to claim 8, wherein said thickness is 0.125 mm.

10. The toner box according to claim 8, wherein said shaft includes a central blade formed opposite said cleaning member as part of the thin film.

11. The toner box according to claim 10, wherein said shaft includes at least one hooking element for attaching the thin film to the shaft.

12. In combination, a toner developing unit coupleable to a removable toner storage box, comprising:

a developing case having a support;

a toner fillable casing mountable on the support;

a toner level detecting device on the toner fillable casing, comprising:

first and second toner detecting portions formed of a light transmissive material, and a toner fillable aperture having a substantially non-uniform cross-sectional width from the top of the aperture to the bottom of the aperture, said toner fillable aperture being formed between the first and second toner detecting portions; and a toner level detector mounted adjacent the development case, said toner level detector cooperating with the first and second toner detecting portions and said toner fillable aperture to provide an indication of the amount of toner within the toner fillable aperture.

13. The combination according to claim 12, further comprising a ramped toner detector support along which the toner detector is fixedly attached in an optimum toner detecting position.

14. The combination according to claim 12, wherein said toner fillable aperture is a blow-molded toner fillable aperture, and wherein said toner fillable casing further includes:

a rotating shaft provided in said casing, said rotating shaft being rotatable by a mechanism outside the casing, and a cleaning member attached to said rotating shaft, wherein rotation of the rotating shaft causes the cleaning member to pass between opposed inner surfaces of said first and second toner detecting portions to clean toner from inner surfaces of the blow-molded toner fillable aperture.

15. The combination according to claim 14, wherein said cleaning member includes a pair of opposed flexible members that conform to the non-uniform width of the blow-molded aperture to clean said inner surfaces.

16. The combination according to claim 15, wherein the blow-molded aperture is substantially V-shaped.

17. The combination according to claim 15, wherein the blow-molded aperture is substantially U-shaped.

18. The combination according to claim 15, wherein each of said opposed flexible members includes a slit to allow a lower portion of each of said opposed flexible members to deform an amount different than that of an upper portion of each of said opposed flexible members closer to the shaft.

19. The combination according to claim 12, wherein the first and second toner detecting portions are rotatable into a proper detecting position with respect to the toner detector.

20. A toner level detecting device on a toner fillable box, comprising:

a toner fillable body;

first and second toner detecting portions formed on the toner fillable body and structured to receive a toner level detector; and a blow-molded toner fillable aperture formed between the first and second toner detecting portions on the toner fillable body, said blow-molded toner fillable aperture being detected using the toner level detector to provide an indication of toner level within the toner fillable body, wherein at least a portion of the blow-molded toner fillable aperture is formed from a semi-transparent material that absorbs latent light that might otherwise cause a false indication of the toner level.

21. The toner level detecting device according to claim 20, wherein the blow-molded toner fillable aperture has a substantially non-uniform cross-sectional width.

22. The toner level detecting device according to claim 21, wherein said cross-sectional width is substantially V-shaped.

* * * * *